United States Patent [19]

Mills et al.

[11] 4,079,020

[45] Mar. 14, 1978

[54] CLEANING COMPOSITION

[75] Inventors: Anthony Kinnaird Mills; Peter Winterbotham, both of Wirral, England

[73] Assignee: Lever Brothers Company, New York, N.Y.

[21] Appl. No.: 738,911

[22] Filed: Nov. 4, 1976

[51] Int. Cl.[2] ..... C11D 1/83; C11D 1/835; C11D 3/16

[52] U.S. Cl. ..... 252/547; 252/550; 252/551; 252/552; 252/554; 252/DIG. 14; 252/DIG. 17

[58] Field of Search ..... 252/89, 132, 550, 551, 252/552, 554, 547, DIG. 14, DIG. 15, DIG. 17

[56] References Cited

U.S. PATENT DOCUMENTS

| | | | |
|---|---|---|---|
| 3,548,056 | 12/1970 | Eigen et al. | 424/171 |
| 3,898,186 | 8/1975 | Mermelstein et al. | 252/528 |
| 3,928,249 | 12/1975 | Nunziata et al. | 252/526 |
| 3,936,317 | 2/1976 | Lehmann et al. | 134/29 |
| 3,941,713 | 3/1976 | Dawson et al. | 252/142 |
| 3,963,635 | 6/1976 | Dawson et al. | 252/142 |
| 3,963,649 | 6/1976 | Spadini et al. | 252/546 |

*Primary Examiner*—P.E. Willis, Jr.
*Attorney, Agent, or Firm*—Michael J. Kelly; Melvin H. Kurtz; James J. Farrell

[57] ABSTRACT

A dishwashing composition comprising an active-detergent system containing a secondary alkyl sulphonate/-sulphate and an alkylethersulphate or a nonionic surface-active compound, which includes a small amount of casein, said dishwashing composition having good drain-dry properties, obviating cloth-drying of the washed articles.

12 Claims, No Drawings

CLEANING COMPOSITION

This invention relates to a cleaning composition, and particularly to a cleaning composition suitable for use in the dishwashing area, for washing cups, dishes, glassware, crockery, pots and pans, glazed objects etc. The invention is, however, especially concerned with a dishwashing composition for use in manual dishwashing operations.

In manual dishwashing operations, the objects to be cleaned are usually washed in a hand-warm aqueous solution of a suitable dishwashing composition, and subsequently put on a rack and dried with a tea-cloth. During the period between the cleaning and the cloth-drying some of the wash liquor may dry up on the objects and leave spots or streaky films. This can be reduced by rinsing the cleaned objects with running tap water or immersing them in a bowl with clean water, but the film of water on the objects left on the rack may not drain and dry evenly or quickly and the consequence thereof is that they may need to be polished or cloth-dried to prevent spotting. It has already been proposed to improve the "drainage" properties of dishwashing compositions by inclusion of gelatin which allows a "sheeting-off" effect. Objects cleaned with such compositions may, after having been rinsed under running tap water, be left to stand and drain, thus obviating a cloth-drying operation.

It has now been found that the inclusion of a small amount of casein in dishwashing compositions that comprise an active detergent system containing a secondary alkyl sulphonate/sulphate and an alkylethersulphate or a nonionic detergent provides for a dishwashing composition with improved "sheeting-off" properties and improved "drain-dry" properties on rinsing.

The effect found must be surprising since casein belongs to quite a different class of proteins than gelatin. Casein is a phosphoprotein whereas gelatin is a scleroprotein. Certainly the drain-dry effect is not a property that can be attributed to proteins in general. Experiments have shown that a number of protein-types, such as egg-albumin, bovine albumin, $\beta$-lactoglobulin, pepsin, fibrinogen and various protein hydrolysates were found ineffective.

Also, apparently certain compatibility and concerted action rules between casein and the active detergent system must be fulfilled in order to provide for a good drain-dry effect in conjunction with a good dishwashing performance.

Though other anionic organic sulphonate or sulphate surface-active compounds e.g. the alkylbenzenesulphonates, olefinsulphonates, primary alkyl sulphates and the primary alkyl sulphonates, can be used in replacement of the secondary alkyl sulphonate, these actives alone, without the presence of a secondary alkyl sulphonate will not be as compatible with the casein to produce positively a good drain-dry effect as compared to compositions containing a secondary alkyl sulphonate, the proportion of which may be as low as 1% by weight, based on the total composition, in the presence of other anionic organic surface active-agents as stated above. However, it has been found that the secondary alkyl sulphonate can be replaced by the similarly structured compound, i.e. secondary alkyl sulphate, without any loss in performance.

The secondary alkyl sulphonate used in the invention can be obtained by sulphonating $C_8$–$C_{24}$, preferably $C_{12-18}$ alkanes with a suitable sulphonating agent, and subsequently neutralizing the sulphonic acids to their suitable salts.

Other methods of obtaining secondary alkyl sulphonates are by sulphochlorination or sulphoxidation of alkanes, or by the bisulphite-addition to suitable alkanes. The secondary alkyl sulphonates to be used in the present invention are the alkali metal, ammonium and substituted ammonium salts thereof, the alkali metal salts, particularly the sodium salts being preferred. Mixtures of secondary alkyl sulphonates having different chain lengths are also suitable. The secondary alkyl sulphate for use in the present invention may be obtained by reacting $C_8$–$C_{24}$, preferably $C_{12-18}$ olefins with sulphuric acid, or by sulphation of the corresponding secondary alcohols, followed by neutralization. It is used in the form of its alkali metal, ammonium or substituted ammonium salts.

The active detergent system furher comprises an alkylethersulphate and/or a nonionic detergent compound.

The alkylethersulphates are salts of the monosulphuric acid esters of $C_8$–$C_{24}$ primary or secondary, straight or branched chain alcohols, which have been condensed with 1–10 moles of an alkylene oxide, e.g. ethylene oxide and/or propylene oxide. Particularly suitable are the $C_{12}$–$C_{18}$ primary alcohols condensed with from 1–5 moles of ethylene oxide, which have subsequently been sulphated and neutralized.

A typical example thereof is laurylethersulphate containing 3 moles of ethylene oxide; another typical example is a secondary $C_{11}$–$C_{15}$ alcohol condensed with 3 moles of ethylene oxide and subsequently sulphated and neutralized.

The salts of the alkylethersulphates are the alkali metal, ammonium, and substituted ammonium salts, again the alkali metal salts, particularly the sodium salts being preferred.

The nonionic detergent actives which can be used in the present invention are generally the alkylene oxide condensation products of primary or secondary, straight or branched chain $C_8$–$C_{24}$ alcohols, $C_8$–$C_{18}$ alkyl or dialkyl phenols, $C_8$–$C_{24}$ fatty acid mono- and diamides, and glycols. In general these condensation products contain from 1–30, usually from 3–25 moles of ethylene oxide and/or propylene oxide.

Typical examples of suitable nonionics of the above group are primary $C_{12}$–$C_{15}$ alcohols condensed with 7–12 moles of ethylene oxide and secondary $C_{11}$–$C_{15}$ alcohols condensed with 9–12 moles of ethylene oxide.

Another group of useful nonionic surfactants which can be used are amine oxides. Amine oxides are reaction products of tertiary amines and hydrogen peroxide or peroxyacids, having the general formula $R\,R_1R_2N \rightarrow 0$, of which R may be aliphatic, aromatic, heterocyclic, alicyclic or combinations thereof. The amine oxides of interest in the present invention have R being a straight or branched chain aliphatic hydrocarbon radical having 8 to 20 carbon atoms, which may be saturated or unsaturated, and $R_1$ and $R_2$ being a methyl-, ethyl-, hydroxymethyl or a hydroxyethyl group.

Typical examples are dodecyldimethylamine oxide and the various fatty acid derived alkyl — $R_1$ $R_2$ — amine oxides, such as coconut dimethylamine oxide.

Mixtures of several of the above nonionic detergents can also be used, including a mixture of nonionics with a short and a long alkylene oxide chain.

Accordingly the invention provides a dishwashing composition comprising a secondary $C_8$–$C_{24}$ alkyl sulphonate or sulphate, a $C_8$–$C_{24}$ alkylethersulphate having 1–10 alkylene oxide groups, and/or a nonionic detergent compound, and casein.

The composition of the invention may further comprise any other active detergent materials without departing from the essence of the invention, such as the water-soluble alkylbenzene-sulphonates, olefin sulphonates, primary alkyl sulphonates, and primary alkyl sulphates.

Casein is a known, commercially available, protein obtained from skim milk by acid or enzyme precipitation, a general reference of which can be found in Kirk-Othmer, Encyclopaedia of Chemical Technology 1949, Vol. 3, pages 225–237; and the Encyclopaedia of Polymer Science and Technology 1965, Interscience Publishers, Volume 2, pages 859–871. It has found commercial use in various branches of industry.

The casein to be included in the dishwashing composition of the invention can be $\alpha$, $\alpha_s$, $\beta$, $\gamma$, or whole casein, but for commercial reasons whole casein is preferred. Both acid casein and rennet casein can be used. It can be added as such, dissolved in a small amount of alkali, or as an aqueous solution of commercially available sodium caseinate. The amount of casein to be incorporated in the composition according to the invention is generally from about 0.25 to 5%, and preferably from about 1 to 3% by weight.

The amounts of secondary alkyl sulphonate or sulphate and (alkylethersulphate + nonionic detergent) are:

| | generally | preferably |
|---|---|---|
| secondary alkyl sulphonate/ sulphate | 1–40% | 5–40% |
| alkylethersulphate and/or nonionic detergent | 1–40% | 1–20% |

It is to be understood that the active detergent system always comprises a component (a) comprising a secondary alkyl sulphonate/sulphate, together with a component (b) which is either an alkylethersulphate or a nonionic detergent or both. The weight ratio between the secondary alkyl sulphonate/sulphate and the alkylethersulphate or nonionic detergent will generally be from 5:1 to 1:2 and preferably from 4:1 to 1:1 in the absence of other anionic sulphonate or sulphate type detergents.

In the presence of other anionic sulphonate or sulphate detergents of the type as stated above, these detergents can be grouped in component (a) and the above ratios will apply to component (a) with respect to component (b).

The compositions of the invention may furthermore contain the usual ingredients, commonly incorporated in dishwashing compositions. Such ingredients are hydrotropes, such as ethanol, urea, sodium xylene- and toluene-sulphonate, perfumes, colouring materials, opacifiers, preservatives and so on.

It has also been found that the further inclusion of an organo-phosphorus compound as will be defined hereinafter in the composition of the invention improves drain-drying whilst providing for an additional benefit in that the rinsability of these compositions is enhanced, thereby gaining the full benefit of the invention with less rinsing. The organo-phosphorus compound used here can be a phosphate ester or a phosphonate, having the general formula $R—(EO)_n—(0)_m—PO_3X_2$, wherein R is a straight or branched chain alkyl having 8–18 carbon atoms, or a phenylalkyl hydrocarbon chain wherein the alkyl group has 10–18 carbon atoms; (EO) is an ethylene oxide or propylene oxide group; $n$ is a number from 0–10; $m$ = 0–1; and X is hydrogen, or an alkali metal, ammonium or substituted ammonium cation. Particularly suitable phosphorus compounds are phosphate esters having the general formula $R(EO)_n—OPO_3X_2$, wherein R is a straight chain or branched chain hydrocarbon radical having 8–18 carbon atoms, preferably 11–15 carbon atoms; (EO) is an ethylene oxide or propylene oxide group; $n$ is a number from 0–10, preferably 3–7; and X is hydrogen, or an alkali metal, ammonium or substituted ammonium cation. A typical example is the sodium salt of the monophosphoric acid ester of a $C_{11}$–$C_{15}$ sec. alcohol, condensed with 3 moles of ethylene oxide. The amount of organophosphorus compound, when incorporated, is generally small, in the order of 0.5–5%, preferably 0.5–3.0% by weight of the total composition.

Accordingly in one preferred embodiment of the invention the composition comprising a secondary alkyl sulphonate, an alkylether sulphate or a nonionic surface active compound includes casein and the above preferred phosphate ester in amounts up to 5% of the total composition.

The composition of the invention may be made up in any suitable form, such as powders, aqueous liquids or concentrated non-aqueous liquids. They are preferably, however, in the form of aqueous liquids.

As stated above, the compositions of the invention are particularly suitable for manual dishwashing operations, in which, after cleaning, the cleaned objects are rinsed with running tap water (either hot or cold), or by immersing them in a bowl with clean hot or cold water, and then left to stand to dry. The adhering film of water will rapidly drain or sheet off, and the objects will dry without showing significant spotting or streaking effects.

In the following test the effect of a number of proteins added to the wash bowl — either as a predissolved solution or dispersion — on product performance was examined.

The basic product composition is:

| | |
|---|---|
| sodium secondary $C_{12-16}$ alkyl sulphonate | 16.7% |
| $C_{11-15}$ alcohol/12 ethylene oxide | 8.3% |
| water to 100% | |

Six wash solutions of the above product at a concentration of 0.2% were made. With each wash solution the following test procedure was followed:

Three plates were washed in the wash solution in the absence of soil, rinsed and allowed to dry. Three further plates were treated in the same wash solution following sequential addition of protein (3 × 0.2 gms to 5 liters of wash liquor). Finally 3 more plates were treated with no further addition of soil.

Each wash lasted for 2 minutes, followed by a 4 second rinse under the tap and a brief immersion in a rinse bowl containing the same tap water. The temperature of both wash and rinse was about 43° C.

The types of protein materials tested were egg-albumin, bovine albumin, $\beta$-lactoglobulin, pepsin, fibrinogen and soluble casein.

All plates washed in the wash solution without protein and with protein other than casein, showed slow draining of the water film and water-hardness spotting and streaks after drying.

Only soluble casein showed a marked beneficial effect on drain-dry performance, even after the first addition to the wash bowl.

The plates washed with the casein-containing wash solution showed an appearance markedly distinct from that of the plates treated otherwise, in that they were substantially free of spotting and streaks.

The invention will now be further illustrated by way of examples.

EXAMPLE I

| The following composition was made: | % by weight |
|---|---|
| sodium $C_{12}$–$C_{16}$ secondary alkyl sulphonate | 16.67 |
| secondary $C_{11}$–$C_{15}$ alcohol, condensed with 12 moles ethylene oxide | 8.33 |
| soluble casein (sodium caseinate) | 1.25 |
| water | to 100 |

Dark plates and glasses, both soiled (milk, potato, rice pudding and meat soil) and unsoiled, were cleaned in a wash bowl at a temperature between 40°–45° C with a product concentration of 0.05 and 0.2% in water of 40° FH. After washing, the objects were immediately rinsed for at least 4 seconds with water of 40°–45° C and 40° FH.

The drainage effects without soil were good, particularly at 0.2% and on glasses, and with soil there was a good overall drainage effect at both concentrations, with substantially no spotting and no streaky films.

EXAMPLE II

The following liquid compositions were made:

| | % by weight | |
|---|---|---|
| sodium sec. $C_{12}$–$C_{16}$ alkyl sulphonate | 20 | 22.5 |
| sodium laurylethersulphate (containing 3 moles of ethylene oxide) | 5 | — |
| sec. $C_{11}$–$C_{15}$ alcohol condensed with 12 moles ethylene oxide | — | 7.5 |
| sodium salt of the monophosphoric acid ester of $C_{11}$–$C_{15}$ alcohol condensed with 3 moles ethylene oxide | 1 | 1.2 |
| alkali-soluble casein | 1.5 | 1.5 |
| lemon juice | 1.0 | 1.0 |
| preservative | 0.02 | 0.02 |
| colouring agent | 0.002 | 0.002 |
| perfume | 0.3 | 0.3 |
| water | up to 100 | up to 100 |
| pH | 8.35 | 8.4 |

These products showed good washing performance and good drain-dry effects, with less rinsing, as compared to a similar product without a phosphate ester.

EXAMPLE III

The following composition exemplifies another formulation according to the invention:

| | % by weight |
|---|---|
| sodium sec. $C_{12}$–$C_{16}$ alkyl sulphonate (as 100% active detergent) | 26.5 |
| sodium laurylethersulphate (containing 3 moles of ethylene oxide) | 6.5 |
| urea | 1.1 |
| denatured ethyl alcohol | 4.5 |
| sodium caseinate | 1.6 |

-continued

| | % by weight |
|---|---|
| perfume, colourants etc. and water | up to 100 |

EXAMPLE IV

The following composition was tested in 24° FH at a concentration 0.15% on plates. The plates were washed for 2 minutes, then given a tap rinse followed by a brief bowl rinse in 24° FH water.

| | % by weight |
|---|---|
| sodium secondary alkyl sulphonate | 22.0 |
| secondary $C_{11}$–$C_{15}$ alcohol condensed with 12 moles of ethylene oxide | 11.0 |
| casein | 1.65 |
| rest water | |

Good drain-dry effects and end result scores were observed.

EXAMPLES V-VIII

The following compositions within the invention were tested and used at a concentration of 1.5 g/l in water of 40° FH. Plates were immersed in the wash liquor (at 40°–45° C) for 30 seconds, then rinsed thoroughly in water of the same hardness and temperature, either under running tap water for 4 seconds, or in a separate rinse bowl (dipped three times into the clean water). All samples gave a good drain-dry effect.

| | % by weight | | | |
|---|---|---|---|---|
| Compositions | V | VI | VII | VIII |
| sodium $C_{10-12}$ alkylbenzenesulphonate | 4.3 | — | — | — |
| sodium sec. $C_{12-18}$ alkyl sulphonate | 21.2 | 26.4 | — | — |
| sodium sec. $C_{11}$–$C_{17}$ alkyl sulphate | — | — | 22.6 | 26.5 |
| sodium lauryl-3 EO-sulphate | 10.2 | 6.6 | — | 6.5 |
| coconut dimethylamine oxide | — | 8.0 | — | — |
| $C_{11-15}$ sec. alcohol/12 ethylene oxide | — | — | 11.0 | — |
| urea | 3.0 | 9.0 | — | — |
| ethanol | 6.2 | 7.0 | 5.0 | 4.5 |
| sodium caseinate | 1.5 | 1.5 | 1.65 | 1.65 |
| water to | 100.0 | 100.0 | 100.0 | 100.0 |

We claim:

1. An aqueous liquid dishwashing composition comprising:

(a) 1 to 40%, by weight of said composition of a secondary $C_8$–$C_{24}$ alkyl sulphonate or a secondary $C_8$–$C_{24}$ alkyl sulphate;

(b) 1 to 40% by weight of said composition of a $C_8$–$C_{24}$ alkylethersulphate having 1 to 10 alkylene oxide groups, or a nonionic detergent active compound; and (c) 0.25 to 5.0% by weight of soluble casein.

2. A dishwashing composition according to claim 1, wherein said casein is sodium caseinate.

3. A dishwashing composition according to claim 1, wherein component (a) is present at a level of 5 to 40% by weight; component (b) is present at a level of 1 to 20% by weight; and component (c) is present at a level of 1 to 3% by weight.

4. A dishwashing composition acccording to claim 1, wherein the ratio of component (a) to component (b) is from 5:1 to 1:2.

5. A dishwashing composition according to claim 1 wherein the ratio of component (a) to component (b) is from 4:1 to 1:1.

6. A dishwashing composition according to claim 1, wherein said secondary alkyl sulphonate or sulphate has an alkyl chain of 12 to 18 carbon atoms.

7. A dishwashing composition according to claim 1, wherein said alkylethersulphate is derived from a primary $C_{12}$–$C_{18}$ alcohol condensed with 1 to 5 moles of ethylene oxide.

8. A dishwashing composition according to claim 1, wherein said nonionic detergent-active compound is an amine oxide having the general formula $R\,R_1R_2N \rightarrow 0$, wherein R is a straight or branched chain aliphatic hydrocarbon radical, which may be saturated or unsaturated, having 8 to 20 carbon atoms, and $R_1$ and $R_2$ are methyl, ethyl, hydroxy-methyl, or hydroxyethyl groups.

9. A dishwashing composition according to claim 1, further comprising an organo-phosphorus compound of the general formula $R—(EO)_n—(0)_m—PO_3X_2$, wherein R is a straight or branched chain alkyl having 8 to 18 carbon atoms or a phenylalkyl hydrocarbon chain wherein the alkyl group has 10 to 18 carbon atoms; (e0) is an ethylene oxide or propylene oxide group; $n$ is a number from 0 to 10; $m = 0$ to 1 and X is hydrogen or an alkali metal, ammonium or substituted ammonium cation; in an amount of about 0.5 to 5% by weight based on the total composition.

10. A dishwashing composition according to claim 9, wherein said organo-phosphorus compound is a phosphate ester having the general formula $R(EO)_n—OPO_3X_2$, wherein R is a straight chain or branched chain hydrocarbon radical having 8 to 18 carbon atoms; (EO) is an ethylene oxide or propylene oxide group; $n$ is a number of from 0 to 10; and X is hydrogen or an alkali metal, ammonium or substituted ammonium cation.

11. A dishwashing composition according to claim 9, wherein said phosphate ester has R containing 11 to 15 carbon atoms; $n$ is between 3 and 7; and C is a sodium cation.

12. An Aqueous liquid dishwashing composition comprising:

(a) 1 to 40% by weight of said composition of a secondary $C_8$–$C_{24}$ alkyl sodium sulphonate;

(b) 1 to 40% by weight of said composition of a sodium $C_8$–$C_{24}$ alkylethersulphate, having 1 to 10 alkylene oxide groups, or a nonionic detergent active compound;

(c) 0.25 to 5.0% by weight of said compound of soluble casein; and (d) 0.5 to 5.0% by weight of said composition of a phosphate ester having the general formula $R(EO)_n—OPO_3X$, wherein R is a straight or branched chain hydrocarbon radical having 11 to 15 carbon atoms; (EO) is an ethylene or propylene oxide group; $n$ is a number from 3 to 7; and X is hydrogen, or an alkali metal, ammonium or substituted ammonium cation.

* * * * *

UNITED STATES PATENT AND TRADEMARK OFFICE

CERTIFICATE OF CORRECTION

PATENT NO. : 4,079,020

DATED : March 14, 1978

INVENTOR(S) : Anthony Kinnaird Mills et al.

It is certified that error appears in the above-identified patent and that said Letters Patent are hereby corrected as shown below:

In the title page:

Below "Filed: Nov. 4, 1976" add the following:

-- Foreign Application Priority Data

Nov. 7, 1975 United Kingdom 46213/75 --.

Signed and Sealed this

*Fourteenth* Day of *November 1978*

[SEAL]

*Attest:*

RUTH C. MASON
*Attesting Officer*

DONALD W. BANNER
*Commissioner of Patents and Trademarks*